US008381621B2

(12) United States Patent
Hsieh

(10) Patent No.: US 8,381,621 B2
(45) Date of Patent: Feb. 26, 2013

(54) HAND TOOL ALTERNATELY-MAGNETIZING STRUCTURE

(76) Inventor: Chih-Ching Hsieh, Taichung Hsien (TW)

( * ) Notice: Subject to any disclaimer, the term of this patent is extended or adjusted under 35 U.S.C. 154(b) by 365 days.

(21) Appl. No.: 12/828,827

(22) Filed: Jul. 1, 2010

(65) Prior Publication Data

US 2012/0000325 A1 Jan. 5, 2012

(51) Int. Cl.
*B25B 23/16* (2006.01)
*B25B 15/02* (2006.01)

(52) U.S. Cl. ..... 81/185.2; 81/436

(58) Field of Classification Search ..... 81/185.2, 81/125, 436–439
See application file for complete search history.

(56) References Cited

U.S. PATENT DOCUMENTS

| | | | | |
|---|---|---|---|---|
| 6,278,349 | B1 * | 8/2001 | Giffin | 335/284 |
| 7,093,524 | B2 * | 8/2006 | Hsieh | 81/492 |
| 7,261,212 | B2 * | 8/2007 | Sholem | 211/70.6 |
| 2009/0031867 | A1 * | 2/2009 | Andronica et al. | 81/436 |

FOREIGN PATENT DOCUMENTS

| | | |
|---|---|---|
| TW | I265846 | 11/2006 |
| TW | M342246 | 10/2008 |

* cited by examiner

*Primary Examiner* — Hadi Shakeri
(74) *Attorney, Agent, or Firm* — Guice Patents PLLC

(57) ABSTRACT

A hand tool alternately-magnetizing structure includes a body, at least one magnetic component, and an adjustment ring. The body defines a central axis and a handle portion; in which defines at least one recess dented along a radical direction thereof. The magnetic component is received in the recess of the handle portion, and includes a resilient member and a magnetic member. The adjustment ring is sleeved onto the handle portion and capable of angular displacement, and defines at least one switchable portion dented at an interior wall face thereof for corresponding to the recess of the handle portion. The switchable portion describes an adjacent section and an outlaying section, wherein a wall thickness defined at the adjacent section is greater than that defined at the outlaying section. The effective magnetic field is adjusted by selectively aligning the adjacent section and the outlaying section with the recess of the handle portion.

16 Claims, 5 Drawing Sheets

HAND TOOL ALTERNATELY-MAGNETIZING STRUCTURE

BACKGROUND

1. Field of the Invention

The present invention relates generally to a hand tool, and is more specifically concerned with an alternately-magnetizing structure of a hand tool.

2. Background of the Invention

For the easy storage or the convenient orientation of the hand tools, a magnet applied to the conventional hand tool for attaching to a kid of tool case or to a stage at work spot is employed popularly, as disclosed in TW Utility Patent No. M342246 entitled "CLAMP EQUIPPED WITH MAGNET", or TW Invention Patent No. 1265846 entitled "HANDLE MAGNETIC STRUCTURE IMPROVEMENT OF SCREWDRIVER".

The magnet disclosed in the prior art is of permanent magnetism for meeting requirements mentioned above. However, if the hand tool equipped with magnet is applied to the work field with precision instrumentation, the permanent magnetism of the magnet may interfere with the electronic component of the precision instrumentation. The magnet of the hand tool, perhaps, attracts unnecessary components while in use, and it creates new troubles for users. Therefore, whether the magnetism status of the hand tool is switched on or off would be a solution to the addressed problems.

SUMMARY OF THE INVENTION

A primary object of the present invention is to provide a hand tool alternately-magnetizing structure, in which a magnetism attraction is offered and a switch of the magnetism is presented.

Another object of the present invention is to provide a hand tool alternately-magnetizing structure, in which the switch of the magnetism is achieved by providing radical motion of the effective magnetic field of a magnetic member.

Another object of the present invention is to provide a hand tool alternately-magnetizing structure, in which the switch of the magnetism is met with low primary costs and easy manipulation by presenting the simple structure.

According to primary aspect of the present invention, a hand tool alternately-magnetizing structure includes a body, at least one magnetic component, and an adjustment ring. The body defines a central axis, and has a handle portion at a section and an operation portion at an opposite section; wherein the handle portion defines at least one recess dented along a radical direction thereof. The magnetic component is received in the recess of the handle portion, and includes a resilient member and a magnetic member; wherein the magnetic member defines an effective magnetic field within predetermined confines. The adjustment ring is sleeved onto the handle portion of the body and capable of angular displacement. The adjustment ring defines at least one switchable portion dented at an interior wall face thereof for corresponding to the recess of the handle portion of the body. The switchable portion describes an adjacent section and an outlaying section, wherein a wall thickness defined at the adjacent section is greater than that defined at the outlaying section.

When the outlaying section of the switchable portion is set to align with the recess of the handle portion due to the angular displacement, the effective magnetic field of the magnetic member reaches an extramural area, which situates out of the handle portion. On the contrary, when the adjacent section of the switchable portion is set to align with the recess of the handle portion due to the angular displacement, the effective magnetic field of the magnetic member fades into an intramural area, which situates inside the handle portion. Due to the radical motion the effective magnetic field of the magnetic member, the hand tool presents an alternate-magnetism effect thereby.

BRIEF DESCRIPTION OF THE DRAWINGS

These objects and advantages of the present invention will be more readily apparent after consideration of the following description in conjunction with the drawings.

DETAILED DESCRIPTION OF PREFERRED EMBODIMENTS

Figure 1:
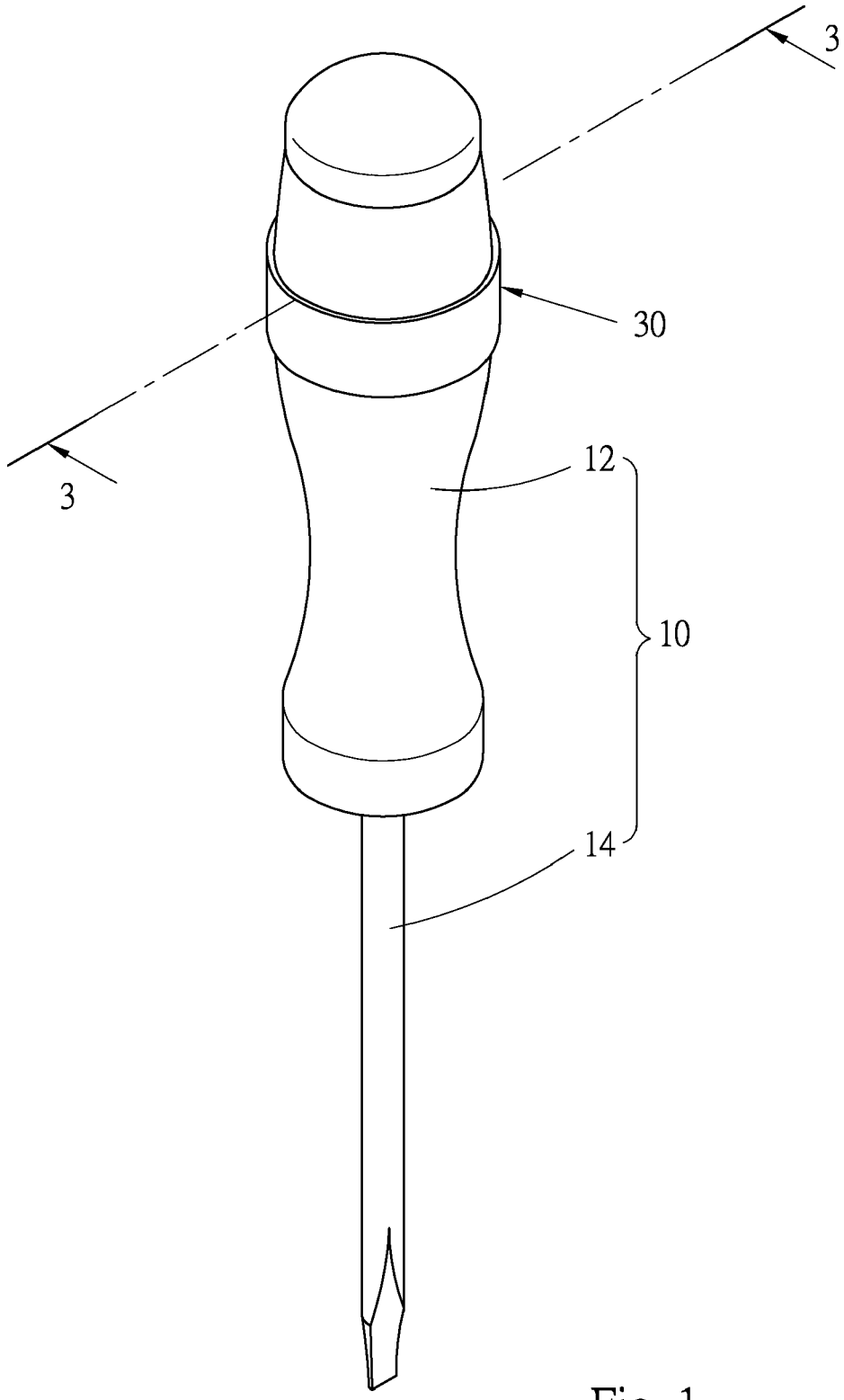
FIG. 1 is a perspective view illustrating a preferred embodiment of a hand tool alternately-magnetizing structure according to the present invention.
Figure 2:
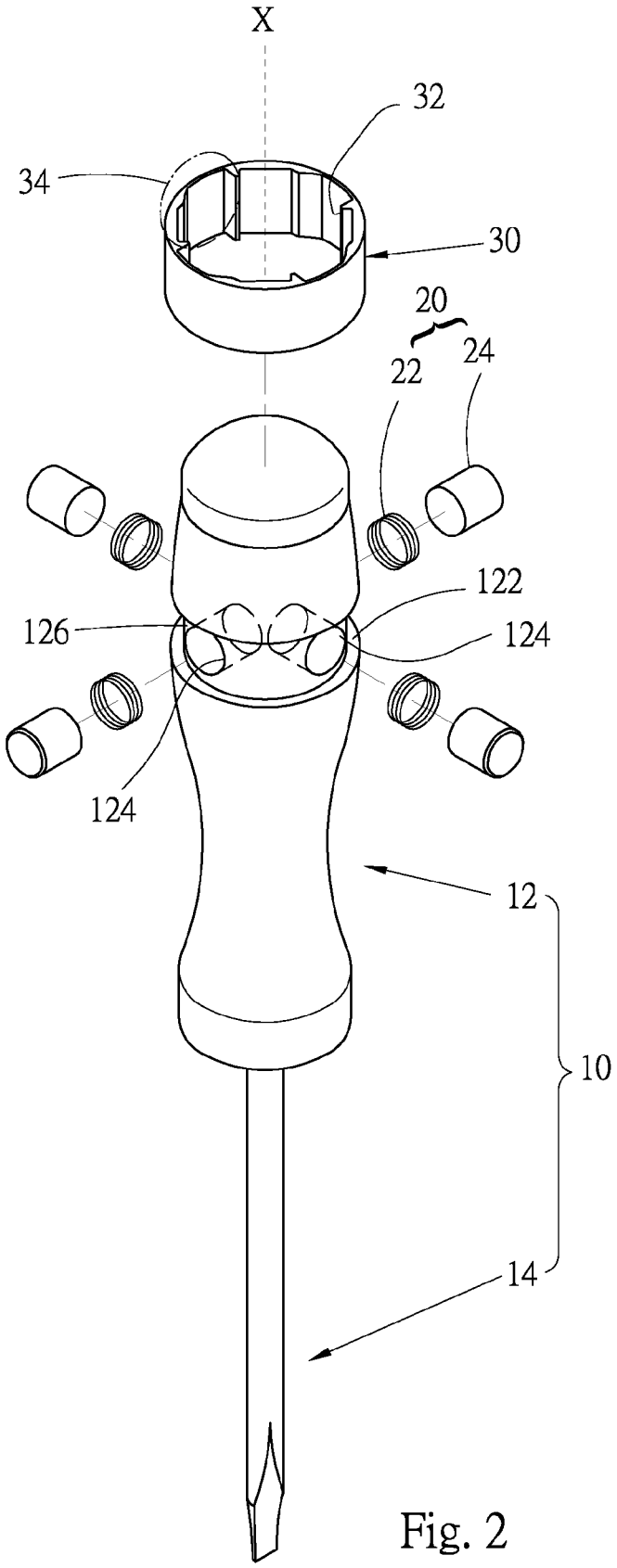
FIG. 2 is a decomposition view illustrating the preferred embodiment of the hand tool alternately-magnetizing structure according to the present invention.

Certain embodiments as disclosed herein provide for a first preferred embodiment of a hand tool alternately-magnetizing structure, referred in FIGS. 1 and 2, including a body 10 and at least one magnetic component 20, and an adjustment ring 30.

Figure 3:
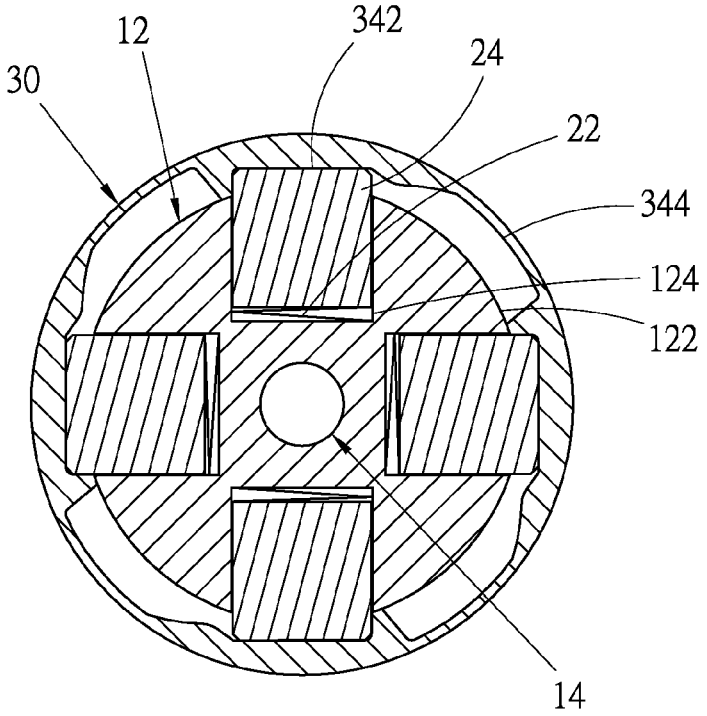
FIG. 3 is a cross-sectional profile in accordance with a line 3-3 of FIG. 1, when the hand tool alternately-magnetizing structure is in a magnetization-off state.

The body 10 defines a central axis X, and has a handle portion 12 at a section and an operation portion 14 at an opposite section. The handle portion 12 defines a circular groove 122 and at least one recess 124 along a radical direction thereof. The circular groove 122 communicates with the recess 124, as illustrated in FIG. 3A. The magnetic component 20 is received in the recess 124 of the handle portion 12. The adjustment ring 30 sleeves onto the handle portion 12 and fits the circular groove 122 for being capable of angular displacement.

Figure 3B:
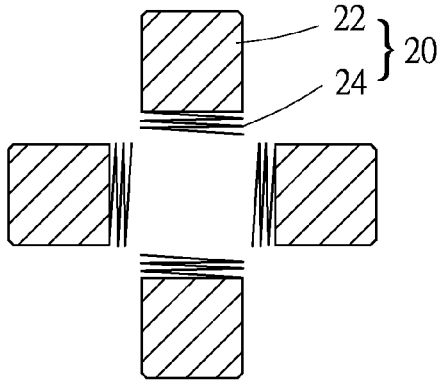
FIGS. 3A to 3C are cross-sectional profiles of the respective parts in accordance with FIG. 3.
Figure 3A:
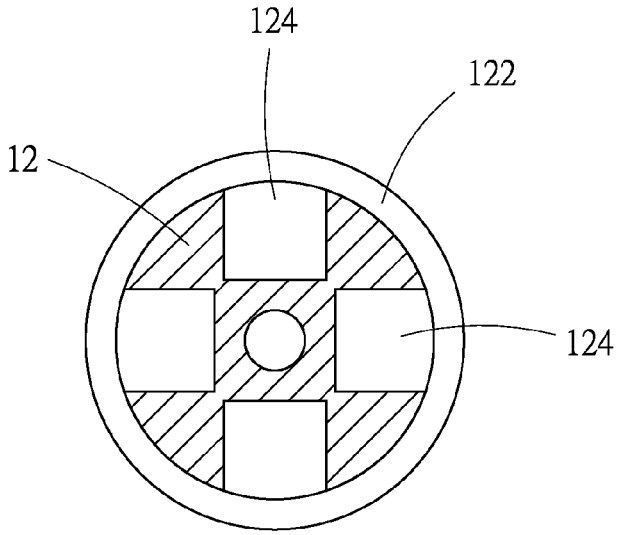

The magnetic component 20 is received in the recess 124 of the handle portion 12, and includes a resilient member 22 and a magnetic member 24 in sequence, as illustrated in FIG. 3B. The magnetic member 24 defines an effective magnetic field within predetermined confines. The magnetic member 24 moves outwards by the impetus of the resilient member 22, so that the effective magnetic field of the magnetic member 24 is of radical motion. An interior wall face 32 of the adjustment ring 30 abuts against an exterior wall face 126 of the handle portion 12 of the body 10. The adjustment ring 30 defines at least one switchable portion 34 dented at the interior wall face 32 for corresponding to the recess 124 of the handle portion 12 of the body 10. A front end of the magnetic member 24 exposes out of the recess 124 of the handle portion 12, so as to abut against the switchable portion 34 of the adjustment ring 30. The quantities of the recess 124, the magnetic component 20 and the switchable portion 34 are in corresponding relationships. In this case, the quantity therein is four.

Figure 3C:
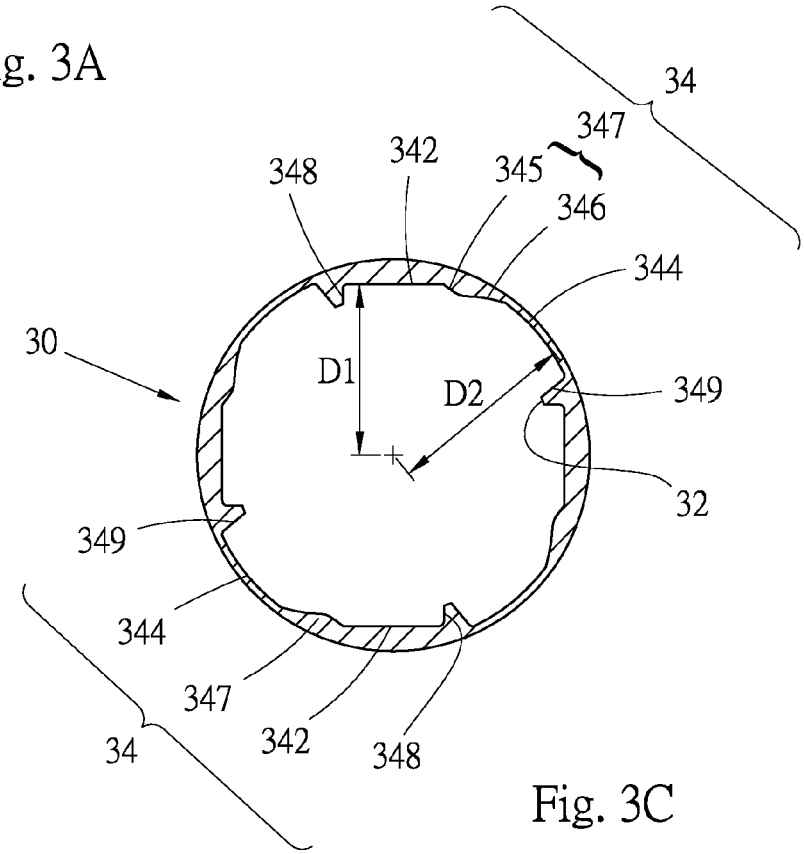

The wall thickness of the switchable portion 34 of the adjustment ring 30 is not identical as shown in FIG. 3C. Due to the various wall thickness of the switchable portion 34, the magnetic member 24 moves inwards or outwards along the radical direction of the handle portion 12 while the switchable portion 34 is in angular displacement; so that the effective magnetic field of the magnetic member 24 is of radical motion and the hand tool presents an alternate-magnetism effect thereby.

The switchable portion 34, relating with the variation of the wall thickness, describes an adjacent section 342, an outlaying section 344, a transitional section 347 connecting the adjacent section 342 and the outlaying section 344, and two restraint walls 348, 349 respectively linking the free ends of the adjacent section 342 and the outlaying section 344. The wall thickness defined at the adjacent section 342 is greater than that defined at the outlaying section 344, so that a diameter D1 measured from the central axis X at the adjacent section 342 is shorter than a diameter D2 measured from the central axis X at the outlaying section 344. The radical movement of the magnetic member 24 ranges between the diameters D1 and D2. The transitional section 347 defines a flat face 345 and a slant face 346 adjoining to each other. The flat face 345 of the transitional section 347 links the adjacent section 342, while the slant face 346 of the transitional section 347 links the outlying section 344. The adjustment ring 30 sleeves on the handle portion 12 by the two restraint walls 348, 349 abutting against a bottom face of circular groove 122.

Figure 4:
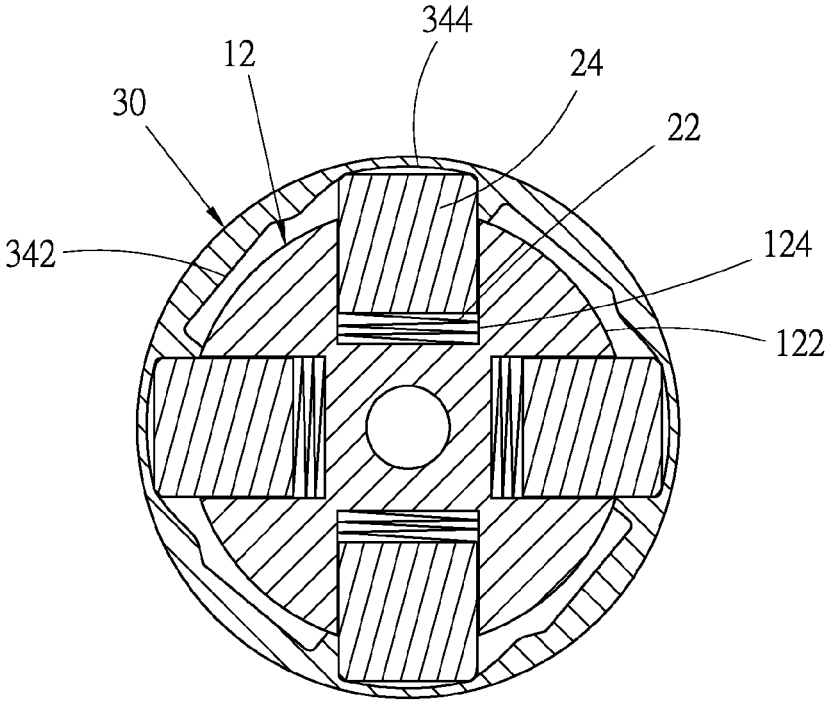
FIG. 4 is a cross-sectional profile according to the present invention, when the hand tool alternately-magnetizing structure is in the magnetization-on state.

With respect to FIG. 3, the adjacent section 342 of the switchable portion 34 is set to align with the recess 124 of the handle portion 12 due to the angular displacement. The front end of the magnetic member 24 of the magnetic component 20 abuts against the adjacent section 342 of the switchable portion 34 and the rear end of the magnetic member 24 forces the resilient member 22 so that the resilient member 22 is of great elastic energy. At this time, the effective magnetic field of the magnetic member 24 locates in an intramural area, which situates inside the handle portion 12. Meanwhile, the hand tool is considered as in a magnetization-off state. With respect to FIG. 4, when the outlaying section 344 of the switchable portion 34 is set to align with the recess 124 of the handle portion 12 due to the angular displacement thereof; the elastic energy of the resilient member 22 turns into the potential energy, so that the magnetic member 24 of the magnetic component 20 moves outwards along the radical direction by the impetus of the resilient member 22. The magnetic member 24 partially goes into the outlaying section 344 of the switchable portion 34 so that the effective magnetic field of the magnetic member 24 reaches an extramural area, which situates out of the handle portion 12. At this case, the hand tool is considered as in a magnetization-on state. Therefore, by manipulating the switchable portion 34 to modify the angular displacement thereof, the magnetism effect is alternate by altering the adjacent section 342 and the outlying section 344 for aligning with the recess 124 of the handle portion 12. The radical motion of the magnetic member 24 presents the switch of the magnetism effect around the extramural area of the handle portion 12 of the hand tool. Therefore, the hand tool creates not only the magnetism attraction but also the switch of the magnetism state.

Figure 5:
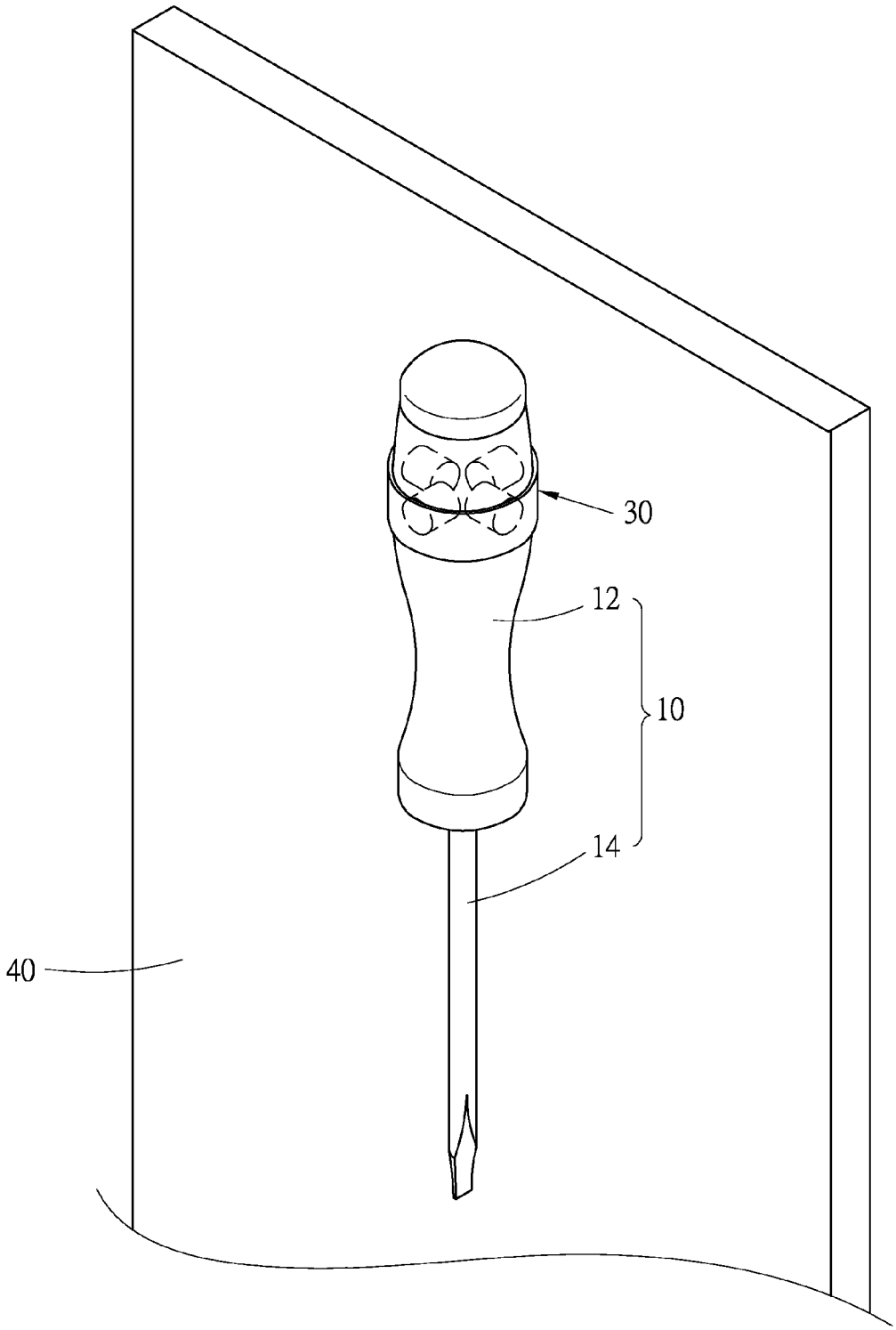
FIG. 5 is a perspective view illustrating an example according to the present invention, when the hand tool alternately-magnetizing structure is in a magnetization-on state.

With respect to FIG. 5, when the hand tool is in the magnetism-on state, the hand toll would attract the magnetic component 40 thereon for convenient storage or operation. When the hand tool is required to be in the magnetism-off state, a slight amount of the angular displacement of the adjustment ring 30 could be set so that the magnetic member 24 is radically pushed to move inwards.

The materials of the adjustment ring 30 and the handle portion 12 of the body, in the common sense, are not able to be magnetized in order to prevent from creating its own persistent magnetic field, which will interfere with the magnetic member 24. Referring back to FIGS. 2 and 3, in this case, the operation portion 14 is made of metallic materials and includes an extension going longitudinally through the handle portion 12. The extension of the operation portion 14 should be arranged out of the effective magnetic field of the magnetic member 24, so as to prevent from the interference between the operation portion 14 and the magnetic member 24 and to keep from the inconvenience at work for the user.

It makes sense that the switch of the magnetism will be achieved by the hand tool alternately-magnetizing structure, which presents simple structure without complicated design and parts. For the manufacture owners, the simple structure thereby is met with low primary costs. Moreover, for the users, the simple structure presents the easy manipulation and the switch of the magnetism by turning the adjustment ring merely.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A hand tool alternately-magnetizing structure comprising:

a body defining a central axis, and having a handle portion at a section and an operation portion at an opposite section; wherein the handle portion defines at least one recess dented along a radical direction thereof;

at least one magnetic component received in the recess of the handle portion, and including a resilient member and a magnetic member in sequence; wherein the magnetic member defines an effective magnetic field within predetermined confines;

the magnetic member moves outwards by the impetus of the resilient member, so that the effective magnetic field of the magnetic member is of radical motion; and an adjustment ring sleeved onto the handle portion of the body and being capable of angular displacement; an interior wall face of the adjustment ring abutting against an exterior wall face of the handle portion of the body, and the adjustment ring defining at least one switchable portion dented at the interior wall face for corresponding to the recess of the handle portion of the body; a front end of the magnetic member exposing out of the recess of the handle portion to abut against the switchable portion of the adjustment ring; the switchable portion describing an adjacent section and an outlaying section, wherein a wall thickness defined at the adjacent section is greater than that defined at the outlaying section;

whereby as the outlaying section of the switchable portion is set to align with the recess of the handle portion due to the angular displacement, the magnetic member of the magnetic component moves outwards along the radical direction to partially go into the outlaying section of the switchable portion so that the effective magnetic field of the magnetic member reaches an extramural area, which situates out of the handle portion; on the contrary, when the adjacent section of the switchable portion is set to align with the recess of the handle portion due to the angular displacement, the magnetic member of the magnetic component moves inwards along the radical direction so that the effective magnetic field of the magnetic member fades into an intramural area, which situates inside the handle portion; due to the radical motion the effective magnetic field of the magnetic member, the hand tool presents an alternate-magnetism effect thereby.

2. The hand tool alternately-magnetizing structure as claimed in claim 1, wherein the switchable portion further describes a transitional section connecting the adjacent section and the outlaying section thereof.

3. The hand tool alternately-magnetizing structure as claimed in claim 2, wherein the transitional section defines a flat face and a slant face adjoining to each other; the flat face of the transitional section links the adjacent section, and the slant face of the transitional section links the outlying section.

4. The hand tool alternately-magnetizing structure as claimed in claim 3, wherein the handle portion defines a circular groove communicated with the recess thereof, the adjustment ring sleeves for fitting the circular groove.

5. The hand tool alternately-magnetizing structure as claimed in claim 4, wherein the operation portion includes an extension going longitudinally through the handle portion; the extension of the operation portion is out of the effective magnetic field of the magnetic member.

6. The hand tool alternately-magnetizing structure as claimed in claim 2, wherein the switchable portion further describes two restraint walls respectively linking the adjacent section and the outlaying section thereof.

7. The hand tool alternately-magnetizing structure as claimed in claim 6, wherein the handle portion defines a circular groove communicated with the recess thereof, the adjustment ring sleeves for fitting the circular groove.

8. The hand tool alternately-magnetizing structure as claimed in claim 7, wherein the operation portion includes an extension going longitudinally through the handle portion; the extension of the operation portion is out of the effective magnetic field of the magnetic member.

9. The hand tool alternately-magnetizing structure as claimed in claim 2, wherein the handle portion defines a circular groove communicated with the recess thereof, the adjustment ring sleeves for fitting the circular groove.

10. The hand tool alternately-magnetizing structure as claimed in claim 9, wherein the operation portion includes an extension going longitudinally through the handle portion; the extension of the operation portion is out of the effective magnetic field of the magnetic member.

11. The hand tool alternately-magnetizing structure as claimed in claim 1, wherein the switchable portion further describes two restraint walls respectively linking the adjacent section and the outlaying section thereof.

12. The hand tool alternately-magnetizing structure as claimed in claim 11, wherein the handle portion defines a circular groove communicated with the recess thereof, the adjustment ring sleeves for fitting the circular groove.

13. The hand tool alternately-magnetizing structure as claimed in claim 12, wherein the operation portion includes an extension going longitudinally through the handle portion; the extension of the operation portion is out of the effective magnetic field of the magnetic member.

14. The hand tool alternately-magnetizing structure as claimed in claim 1, wherein the handle portion defines a circular groove communicated with the recess thereof, the adjustment ring sleeves for fitting the circular groove.

15. The hand tool alternately-magnetizing structure as claimed in claim 14, wherein the operation portion includes an extension going longitudinally through the handle portion; the extension of the operation portion is out of the effective magnetic field of the magnetic member.

16. The hand tool alternately-magnetizing structure as claimed in claim 1, wherein the operation portion includes an extension going longitudinally through the handle portion; the extension of the operation portion is out of the effective magnetic field of the magnetic member.

* * * * *